US008746403B1

(12) United States Patent
Tyner et al.

(10) Patent No.: US 8,746,403 B1
(45) Date of Patent: Jun. 10, 2014

(54) MOBILE BULK CARRIER/ACCESS/FALL PROTECTION SYSTEM

(75) Inventors: Sandy W. Tyner, Hartsville, SC (US); Ronald W. Bennett, Florence, SC (US)

(73) Assignee: Sam Carbis Asset Management, LLC, Florence, SC (US)

( * ) Notice: Subject to any disclaimer, the term of this patent is extended or adjusted under 35 U.S.C. 154(b) by 120 days.

(21) Appl. No.: 13/222,952

(22) Filed: Aug. 31, 2011

Related U.S. Application Data

(60) Provisional application No. 61/378,610, filed on Aug. 31, 2010.

(51) Int. Cl.
*E06C 5/00* (2006.01)

(52) U.S. Cl.
USPC ..... 182/127; 182/113; 182/106

(58) Field of Classification Search
USPC ..... 182/113, 106, 127
See application file for complete search history.

(56) References Cited

U.S. PATENT DOCUMENTS

| | | | | | |
|---|---|---|---|---|---|
| 2,944,625 | A * | 7/1960 | Shore et al. | ..... | 182/106 |
| 3,664,458 | A * | 5/1972 | Sterns et al. | ..... | 182/102 |
| 3,808,757 | A * | 5/1974 | Greenwood | ..... | 52/184 |
| 4,042,064 | A * | 8/1977 | Lobb | ..... | 182/115 |
| 4,530,419 | A * | 7/1985 | Rumage et al. | ..... | 182/106 |
| 4,679,657 | A | 7/1987 | Bennett et al. | | |
| 5,042,612 | A * | 8/1991 | Bennett et al. | ..... | 182/1 |
| 5,299,653 | A * | 4/1994 | Nebel | ..... | 182/2.7 |
| 5,967,258 | A * | 10/1999 | Scott et al. | ..... | 182/113 |
| 6,085,867 | A | 7/2000 | Daniel et al. | | |
| 6,390,152 | B1 | 5/2002 | Donovan et al. | | |
| 6,405,831 | B1 * | 6/2002 | Daniel, III | ..... | 182/127 |
| 6,502,267 | B2 | 1/2003 | MacDonald et al. | | |
| 6,502,709 | B1 | 1/2003 | Parker | | |
| 6,527,081 | B1 | 3/2003 | Tyner et al. | | |
| 6,722,489 | B1 | 4/2004 | Cook | | |
| 6,772,860 | B1 | 8/2004 | Nelson | | |
| 6,814,522 | B1 | 11/2004 | Daniel | | |
| 6,923,140 | B1 | 8/2005 | Cook | | |
| 7,140,467 | B2 | 11/2006 | Cook | | |
| 7,216,741 | B2 | 5/2007 | MacDonald et al. | | |
| 7,762,588 | B2 * | 7/2010 | Markham | ..... | 280/839 |
| 7,798,344 | B2 | 9/2010 | Bennett et al. | | |
| 7,802,652 | B2 | 9/2010 | Bennett et al. | | |
| 7,828,116 | B2 * | 11/2010 | Vetesnik | ..... | 182/18 |
| 7,832,525 | B2 | 11/2010 | Bennett et al. | | |
| 8,015,647 | B2 * | 9/2011 | Bennett | ..... | 14/37 |
| 8,051,951 | B2 | 11/2011 | Bennett et al. | | |
| 2002/0174496 | A1 | 11/2002 | MacDonald et al. | | |
| 2005/0241878 | A1 | 11/2005 | Cook | | |
| 2006/0054392 | A1 | 3/2006 | MacDonald et al. | | |
| 2007/0125600 | A1 | 6/2007 | Bennett et al. | | |
| 2007/0209873 | A1 | 9/2007 | Bennett et al. | | |
| 2009/0256380 | A1 | 10/2009 | Bennett et al. | | |
| 2010/0307868 | A1 | 12/2010 | Bennett et al. | | |
| 2011/0078864 | A1 | 4/2011 | Bennett | | |
| 2011/0127111 | A1 | 6/2011 | Bennett | | |

* cited by examiner

*Primary Examiner* — Alvin Chin-Shue
(74) *Attorney, Agent, or Firm* — Amy Allen Hinson; Nexsen Pruet, LLC

(57) ABSTRACT

A mobile lift unit for accessing bulk carrier top openings for use on a variety of bulk carriers that has a safety cage which is extendable to various heights while protecting operators from potential falls during the use thereof.

7 Claims, 10 Drawing Sheets

MOBILE BULK CARRIER/ACCESS/FALL PROTECTION SYSTEM

CROSS REFERENCE TO RELATED APPLICATIONS

This application claims the benefit of Provisional Application 61/378,610 filed Aug. 31, 2010.

FEDERALLY SPONSORED RESEARCH OR DEVELOPMENT

This invention is not the result of any federally-sponsored research or development program.

JOINT RESEARCH AGREEMENT

This invention is not the result of any joint research or development agreement.

FIELD OF THE INVENTION

This invention relates generally to mobile lifts, and more particularly to a wheeled lift having an elevated platform to access in a safe manner top-loading vehicles.

BACKGROUND OF THE INVENTION

Mobile lifts have been used to elevate materials and workman for a variety of purposes. One such lift is identified in U.S. Pat. No. 6,405,831. Such lifts include a chassis mounted on four wheels with one section of an extension ladder rigidly supported on the chassis. The extension ladder is extended by a hand winch to elevate the platform into an upper position for an appropriate vehicle. The platform extends beyond the chassis to permit placement of personnel beyond the area in which the wheel and chassis are free to travel. Although these previously designed mobile lifts are advantageously used in numerous applications, there remains a need for greater versatility in the applications of such lifts.

SUMMARY OF THE INVENTION

A mobile bulk carrier access and fall prevention lift unit apparatus is disclosed and includes a chassis having wheels mounted for mobility and a safety cage having safety rails and an access opening in the bottom for accessing a bulk carrier opening. Also, an extendable ladder connects the chassis and the safety cage, with the extendable ladder having handrails on all sections thereof. The handrails extend to and connect with the safety rails of the safety cage. Additionally, there is a winch for raising and lowering the extendable ladder and the safety cage. The handrails of the safety cage and the extendable ladder define a gate through which the safety cage might be accessed.

DETAILED DESCRIPTION

Figure 1:
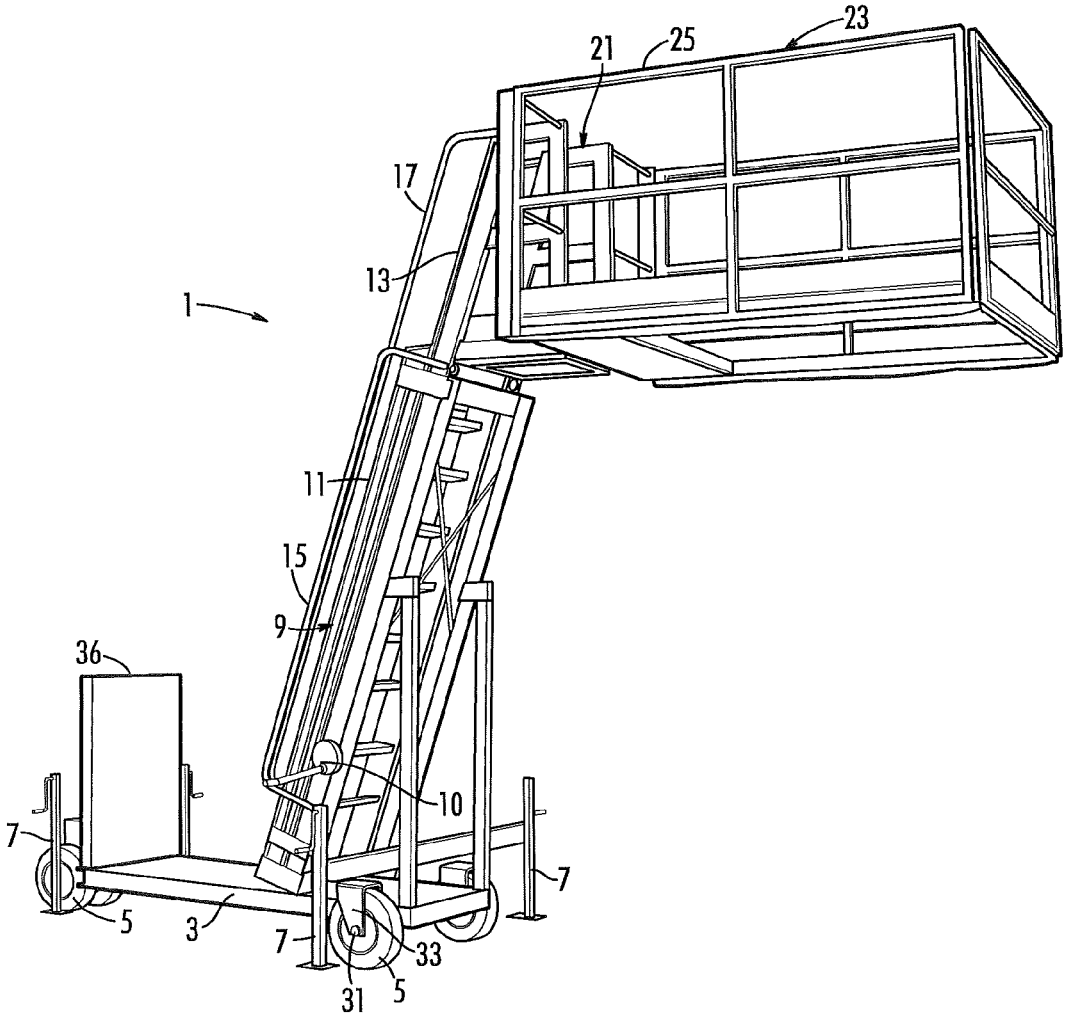
FIG. 1 depicts a mobile lift of this invention.

Depicted in FIG. 1 of the drawings is the mobile lift 1 of this invention. The lift has a chassis 3 supported by wheels 5. Each wheel unit has an associated stabilizing bar 7 located nearby to stabilize the chassis when the mobile lift is in use.

An extendable ladder 9 is operable through winch 10 to extend the ladder to an appropriate height. The extendable ladder has a lower section 11 and an upper section 13. Lower section 11 has handrails 15 associated therewith. Upper section 13 has its own handrails 17 associated therewith. As shown in FIGS. 1-10, the handrails 17 of the upper section 13 are longer than the handrails 15 of the lower section 11. Handrails 17 extend to and connect with the safety cage described below.

Figure 3:
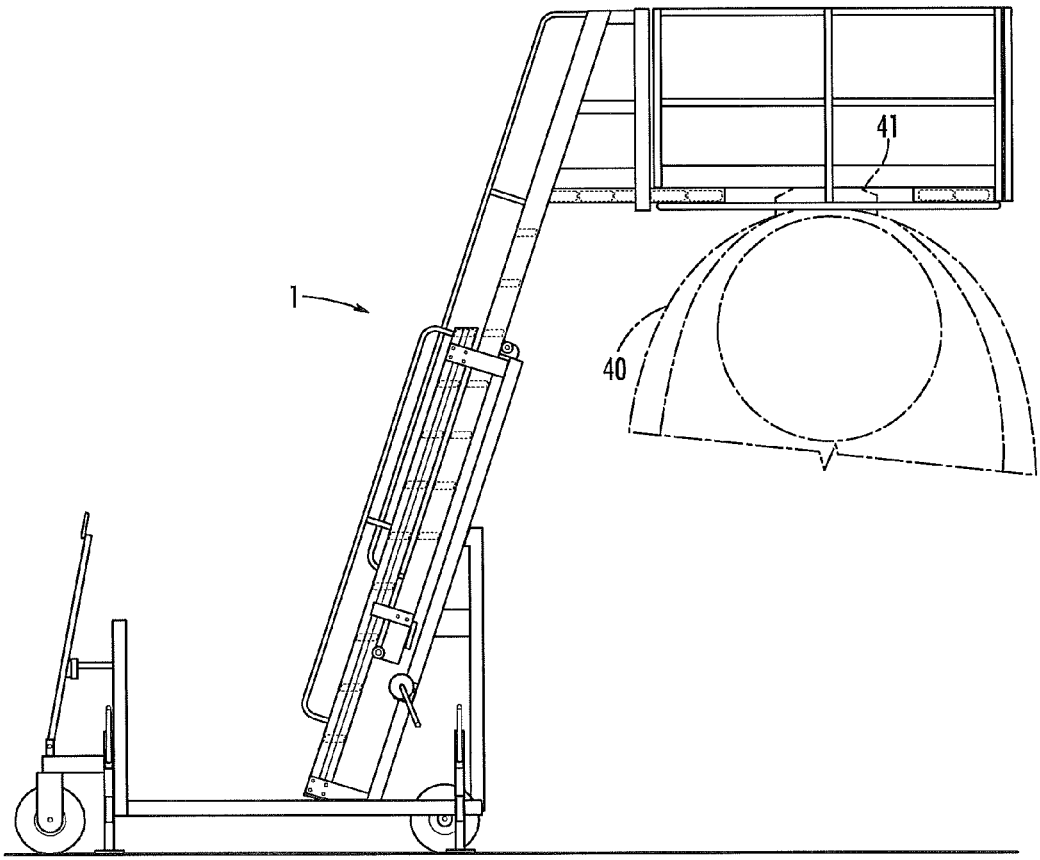
FIG. 3 illustrates the lift unit for use on a hopper truck.

The uppers section 13 of the ladder 9 terminates in a gate 21 which accesses a safety cage supported by the upper ladder section 13. As shown in FIGS. 1 and 3, upper ladder section 13 includes side rails and steps extending therebetween.

Figure 2:
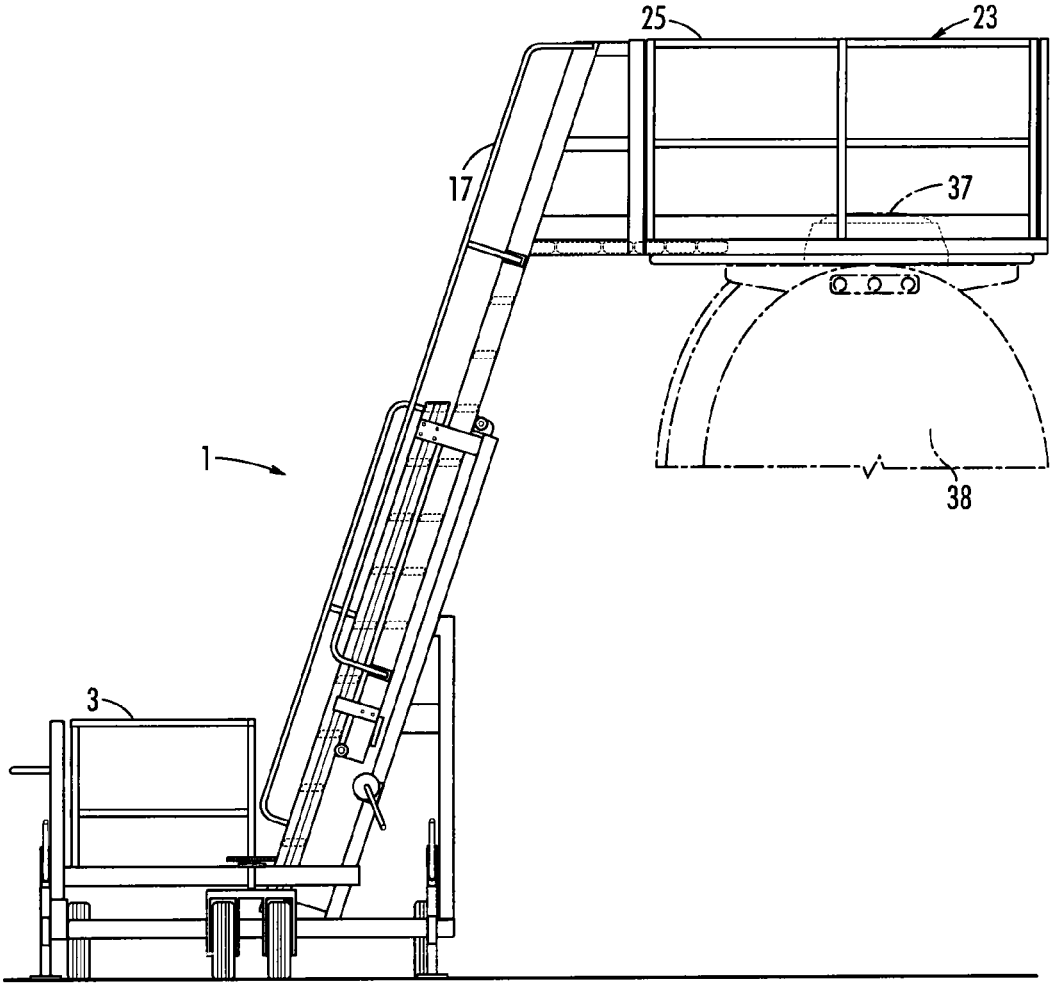
FIG. 2 illustrates the lift unit on a tank truck.

The safety cage 23 has safety rails 25 which extend about the circumference thereof made flush with and connected to the handrail 17 of the upper ladder section 13, FIG. 2

The safety cage 23 is adapted to be removable from the upper ladder section 13 and is capable of being replaced with a different cage configuration so as to be adaptable for various vehicle unloading sections.

The wheels 5 have a shaft 31 and a support mechanism 33 attached to the chassis 3 which results in greater durability.

The gate opening can be closed off for safety reasons with a tracking handrail section that can be operated from the ladder end of the enclosure before stepping onto the carrier. Such tracking gate is disclosed in co-pending U.S. application Ser. No. 12/831,393 filed Jul. 7, 2010. Additionally, a hinged floor panel may be flipped into a blocking relationship for the gate opening while personnel are located within the safety cage 23.

FIG. 2 of the drawings illustrates the device of this invention being utilized to access a tank truck 38 which has an opening 37 therein. In this view, the chassis 5 has been turned 90° from the view of FIG. 1.

FIG. 3 of the drawings illustrates the mobile lift 1 of this invention used to access a hopper truck 40 having an opening 41 therein.

Figure 4:
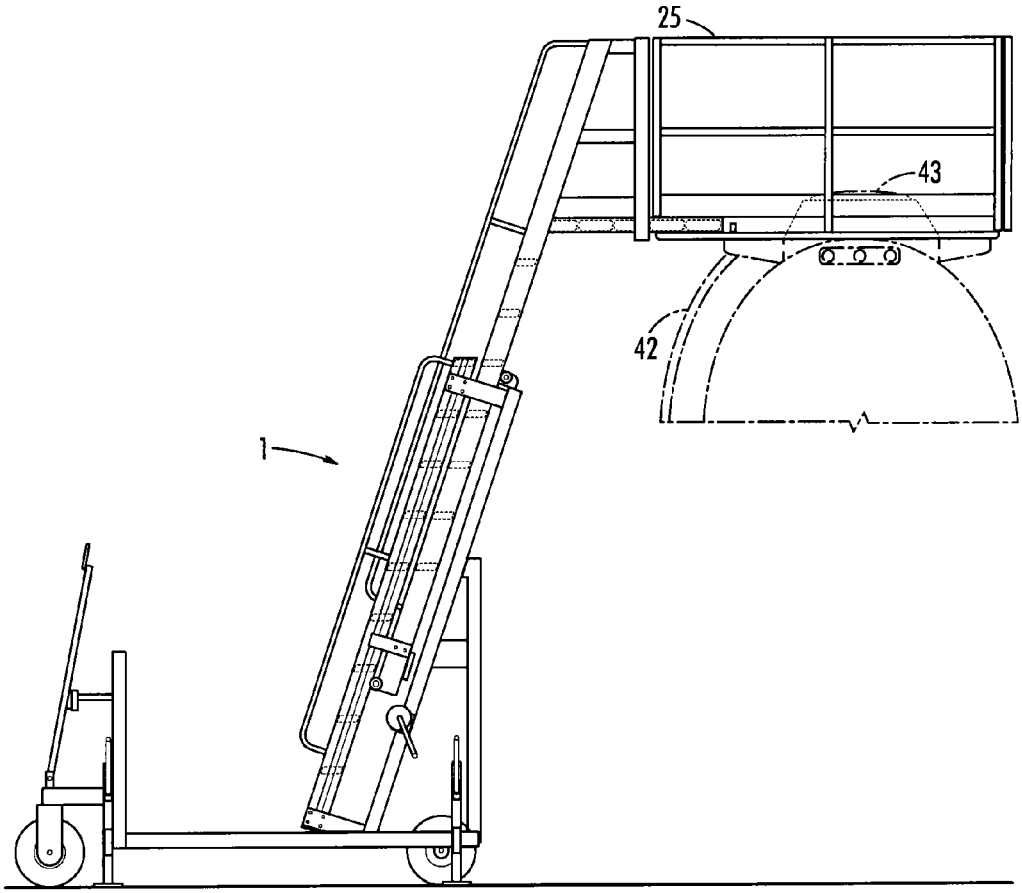
FIG. 4 illustrates the lift unit for use on a tank truck, but shows that the platform handrails are capable of being knocked down for ease of shipping.

FIG. 4 of the drawings illustrates the lift unit of this invention utilized with a tank truck 42 having an opening 43 therein. The safety rails 25 illustrated here are capable of being knocked down for ease of a shipment.

Figure 5:
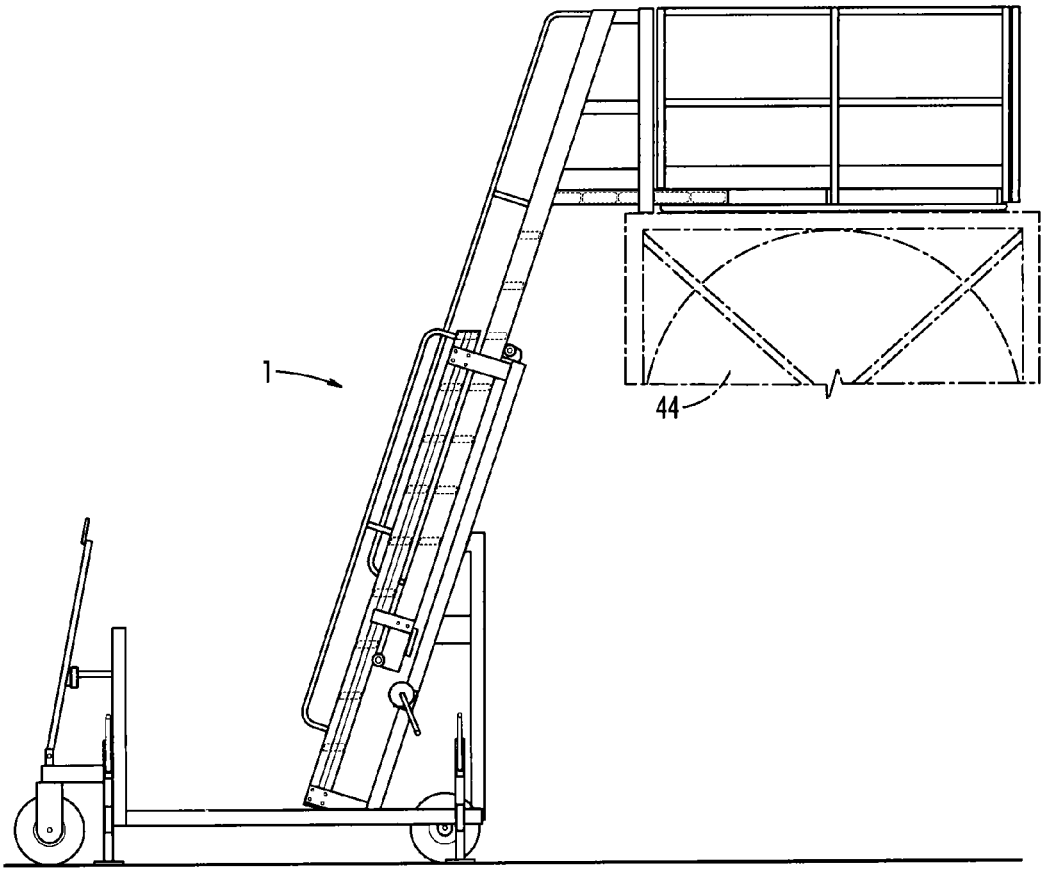
FIG. 5 illustrates the mobile lift for use on iso-container trucks.

FIG. 5 of the drawings illustrates the lift 1 of this invention as applied to an iso container truck 44.

Figure 6:
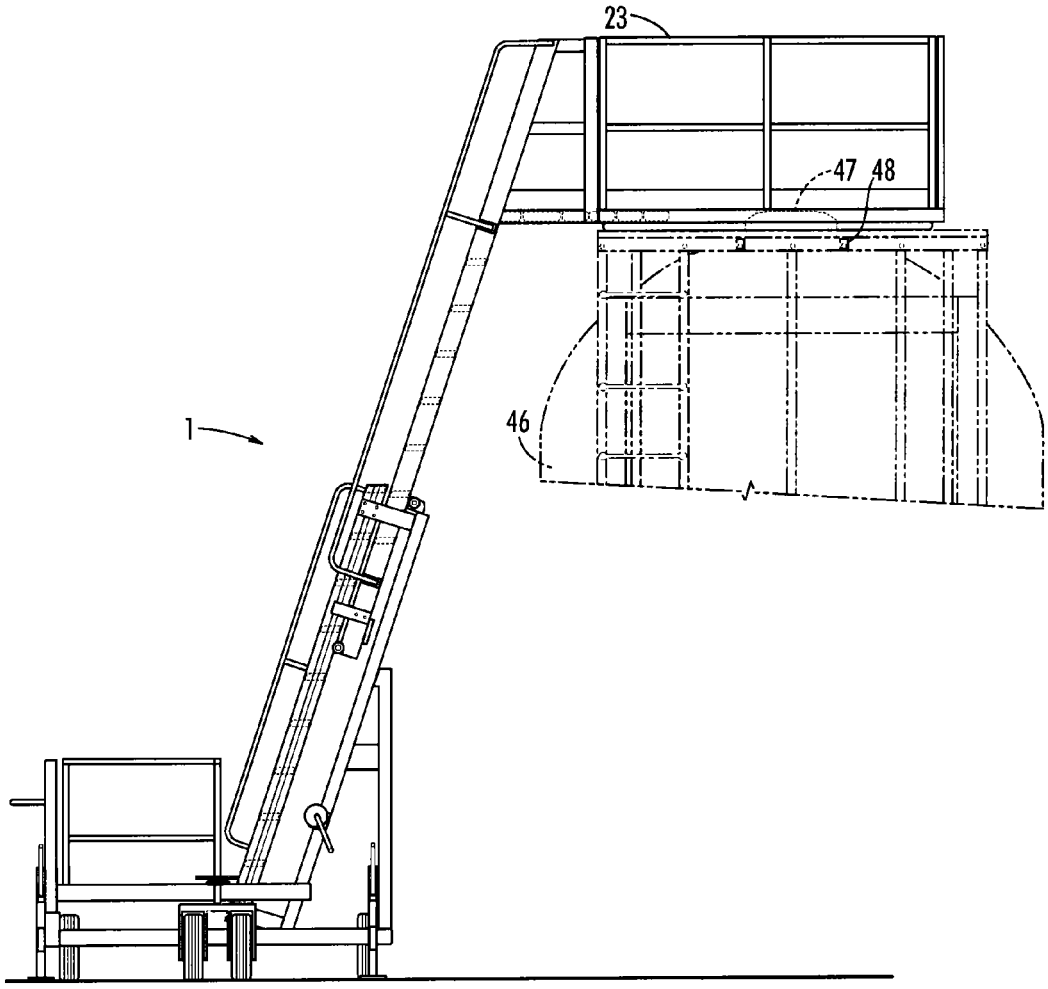
FIG. 6 illustrates the use of the mobile lift unit on hopper cars and shows that padding might be placed around the edge where the platform with the safety cage comes into contact with the vehicle being unloaded.

FIG. 6 of the drawings illustrates the lift unit 1 in association with a hopper car 46 having an opening 47 therein. Padding 48 is illustrated thereon to prevent any marring of the hopper car from contact with the safety cage 23.

Figure 7:
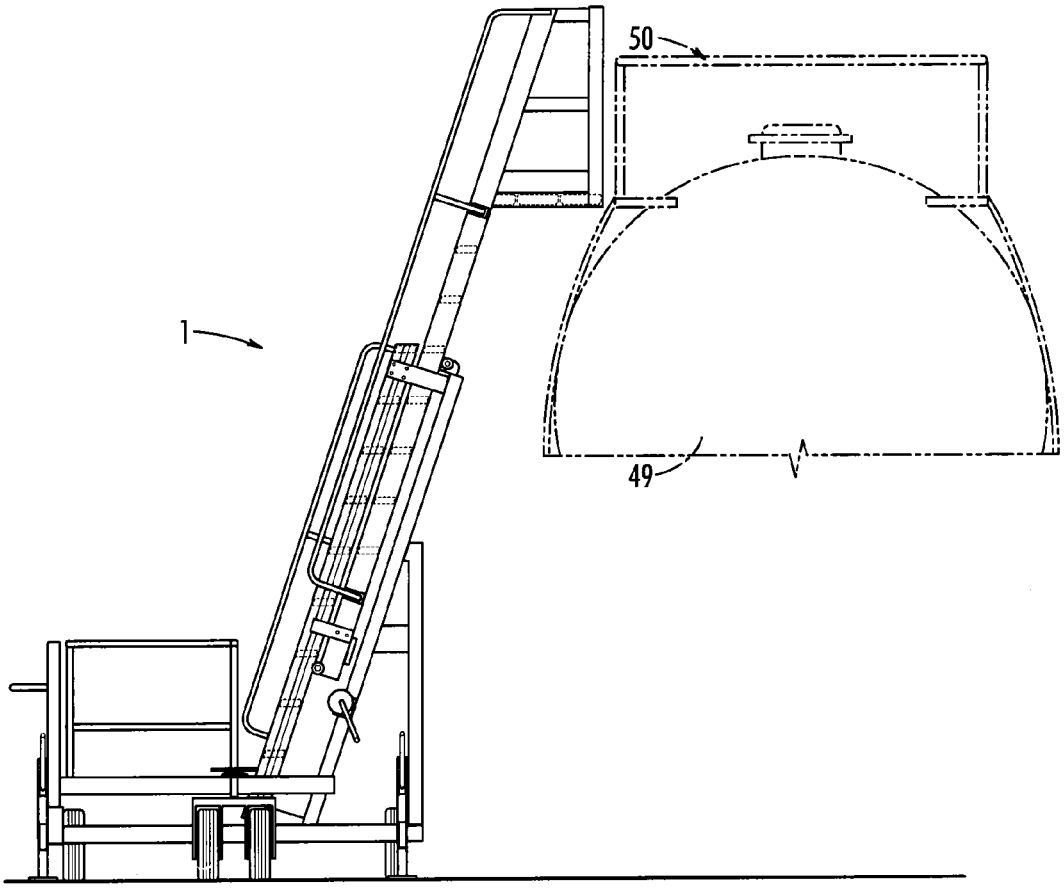
FIG. 7 illustrates the mobile lift unit for use with a railcar.

FIG. 7 illustrates the lift unit 1 in association with a railcar 49, but in a slightly different configuration so as to aid in accessing the railcar 49 when the railcar has its own safety cage 50 associated therewith. In this embodiment, the safety cage 23 has been removed from the upper ladder section 13.

Figure 8:
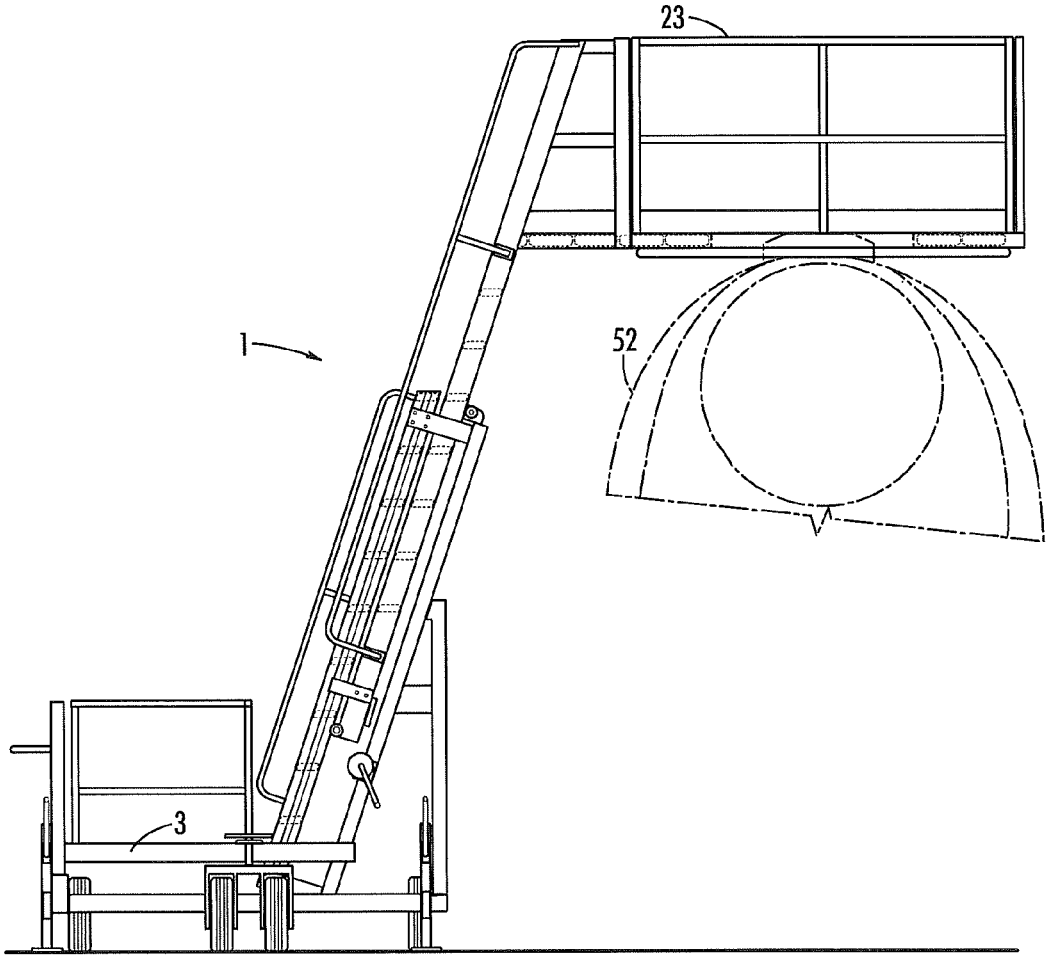
FIG. 8 illustrates the mobile lift unit with a hopper truck.

FIG. 8 illustrates the lift unit 1 of this invention in association with a hopper truck 52, similar to that illustrated in FIG. 3, however, with the chassis 3 at a 90 degree orientation. In this illustration, the safety cage 23 is supported by the hopper truck 52.

Figure 9:
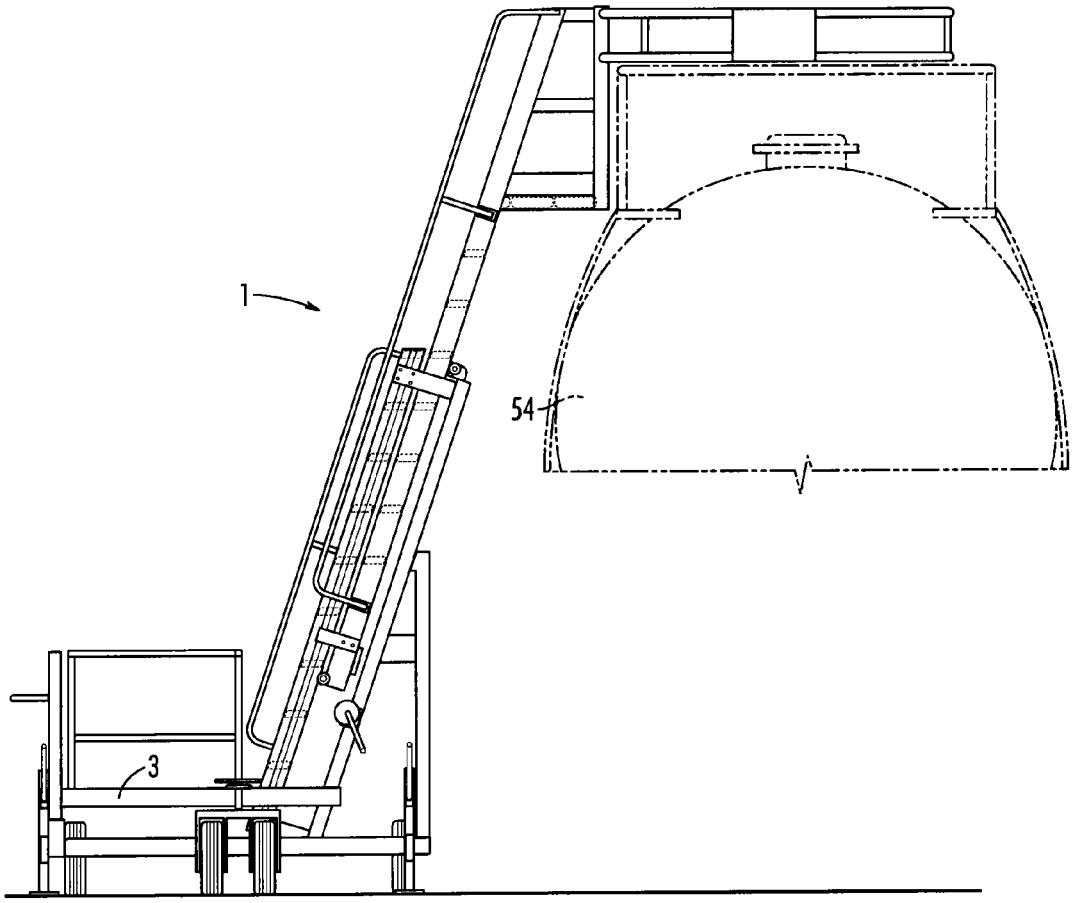
FIG. 9 illustrates the mobile lift unit used in conjunction with a railcar.

FIG. 9 illustrates the mobile lift unit 1, in conjunction with railcar 54, but with the chassis 3 in a 90 degree orientation from that illustrated in FIG. 3.

Figure 10:
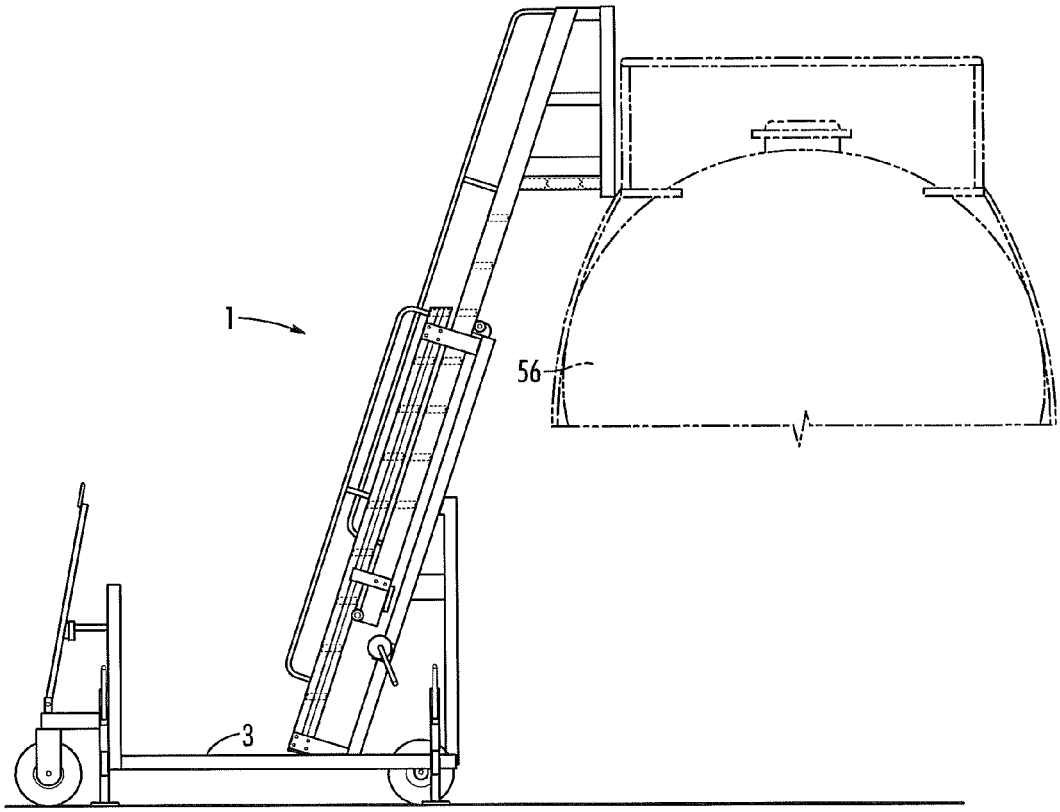
FIG. 10 illustrates another configuration of the mobile lift unit in use with a railcar.

FIG. 10 illustrates the unit 1 in association with a railcar 56, but with the chassis 3 in a different configuration from that illustrated in FIG. 7, in this illustration, the safety cage has been removed.

INDUSTRIAL UTILITY

The lift unit of this invention is for loading and unloading bulk carriers having openings on the top thereof. The unit of this invention is versatile, extending to a variety of heights for use with a variety of carriers. One unit can be used for tank trucks through hopper cars. The development of this invention has increased operating range while maintaining an overlap large enough to support a cantilever platform and its anticipated load. The system is self-supporting and does not need to rest on the carrier. However, if the unit is to be always rested on the carrier then counter-weights 36 can be removed to make the unit lighter and easier to maneuver.

Historically such mobile units required shipping on flatbeds. However due to the construction of this unit it may be knocked down to allow shipping by common carrier or in shipping containers in the case of international shipping.

Having given a general description of the invention, it is apparent that variations thereof will be apparent to those of skill in the art. Such variations are included within the spirit and scope of this invention as defined by the following appended claims.

We claim:

1. A mobile bulk carrier access and fall prevention lift unit apparatus comprising:

a chassis having wheels mounted thereon for mobility;

a safety cage having safety rails located thereabout and an access opening in the bottom thereof for accessing a bulk carrier opening;

an extendable ladder connecting from said chassis to said safety gage, said extendable ladder having upper and lower sections, both with handrails thereon, said upper section having side rails with steps positioned therebetween;

said safety cage being connected to and supported by said upper section;

a winch for raising and lowering the upper section, of said extendable ladder and the safety cage associated therewith;

a counter weight to balance said chassis against the weight of said safety cage;

said safety rails of said safety cage, said side rails of said upper section of said ladder, and said handrails of said extendable ladder defining a gate through which the safety cage might be accessed; and a closing for said gate;

wherein said safety rails of said safety cage comprise a first rail and a second rail, said first rail is the lowest rail of said safety rails and said handrail of said upper section and said side rails of said upper section of said ladder are connected to said safety cage above said first rail, wherein said second rail is the uppermost rail of said safety rails of said safety cage, said handrail of said upper section and said side rails of said upper section of said ladder are the same height as said second rail.

2. The lift unit according to claim 1 wherein said chassis further comprises wheels associated therewith for permitting movement of said chassis by use of said wheels.

3. The lift unit of claim 1 further comprising on a lower section of said safety cage padding to prevent contact with a bulk carrier when said unit is engaged with said carrier.

4. The lift unit of claim 1 wherein said closing for said gate is positioned between said extendable ladder and said safety cage.

5. A mobile bulk carrier access and fall prevention lift unit apparatus comprising:

a chassis having wheels mounted thereon for mobility;

a safety cage having safety rails located thereabout and an access opening in the bottom thereof for accessing a bulk carrier opening;

a counter weight to balance said chassis against the weight of said safety cage;

an extendable ladder connecting from said chassis to said safety gage, said extendable ladder having upper and lower sections, both with handrails thereon, said upper section having side rails with steps positioned therebetween;

said safety cage being connected to and supported by said upper section;

a winch for raising and lowering the upper section, of said extendable ladder and the safety cage associated therewith; and said safety rails of said safety cage, said side rails of said upper section of said ladder, and said handrails of said extendable ladder defining a gate through which the safety cage might be accessed, wherein said safety rails of said safety cage extend about the circumference thereof and said safety rails of said safety cage comprise a first rail and a second rail, said second rail is the uppermost rail of said safe rails of said safety cage, said handrail of said upper section and said side rails of said upper section of said ladder are the same height as said second rail.

6. The lift unit of claim 5 wherein said first rail is the lowest rail of said safety rails of said safety cage, said handrail of said upper section and said side rails of said upper section of said ladder are connected to said gate above said first rail.

7. The lift unit of claim 5 wherein said second rail of said safety rails is the uppermost rail, said handrail of said upper section and said side rails of said upper section of said ladder are connected to and flush with said second rail.

* * * * *